US005955012A

United States Patent [19]

Yingling et al.

[11] Patent Number: 5,955,012

[45] Date of Patent: Sep. 21, 1999

[54] APPARATUS AND METHOD FOR MAKING MELT-BLOWN NONWOVEN SHEETS

[75] Inventors: Timothy W. Yingling, Millers; Charles S. Hoffman, Jr., Baltimore, both of Md.; Robert J. Schmitt, Stewartstown, Pa.

[73] Assignee: USF Fultration and Separations Group Inc., Timonium, Md.

[21] Appl. No.: 08/950,942

[22] Filed: Oct. 16, 1997

Related U.S. Application Data

[62] Division of application No. 08/725,258, Oct. 2, 1996, Pat. No. 5,829,708.

[51] Int. Cl.[6] ..... B29C 47/92; D01D 5/092; D04H 3/00

[52] U.S. Cl. ..... 264/40.5; 156/64; 156/167; 156/173; 156/181; 156/271; 156/378; 156/426; 156/429; 156/441; 156/510; 264/146; 264/211.12; 264/555; 425/72.2; 425/149; 425/224; 425/308; 425/327; 425/447

[58] Field of Search ..... 264/40.5, 146, 264/211.12, 555; 425/72.2, 149, 224, 308, 327, 447; 156/64, 167, 173, 181, 271, 378, 426, 429, 441, 510

[56] References Cited

U.S. PATENT DOCUMENTS

| | | |
|---|---|---|
| 2,176,198 | 10/1939 | Berry . |
| 2,837,293 | 6/1958 | Clem . |
| 3,021,084 | 2/1962 | Long . |
| 3,279,718 | 10/1966 | Arterton et al. . |
| 3,792,820 | 2/1974 | Lucas . |
| 3,905,734 | 9/1975 | Blair . |
| 3,905,736 | 9/1975 | Bringman . |
| 3,909,174 | 9/1975 | Blair et al. . |
| 3,933,557 | 1/1976 | Pall . |
| 4,021,281 | 5/1977 | Pall . |
| 4,032,688 | 6/1977 | Pall . |
| 4,552,317 | 11/1985 | Halter . |
| 4,632,325 | 12/1986 | Feyeri et al. . |
| 4,736,605 | 4/1988 | Klöckner et al. . |

*Primary Examiner*—Leo B. Tentoni
*Attorney, Agent, or Firm*—Nixon & Vanderhye P.C.

[57] ABSTRACT

Substantially constant tension is maintained on a melt-blown nonwoven fibrous sheet by mounting the sheet take-up roller for longitudinal movements relative so as to accommodate the increasing diameter of the sheet material being wound convolutely on the take-up roller. Sheet tension during production is thereby maintained substantially constant by virtue of a continual increase in the longitudinal distance (in relation to the machine direction) between the fiber collection mandrel and the take-up roll. Preferably, tension control is achieved by a pneumatic pressure-regulating system which includes at least one rotatable press roller which is longitudinally fixed in position relative to the collection mandrel and is in contact with the sheet material being wound around the take-up roll. The take-up roller is pneumatically advanced toward the press roller by the pneumatic actuation of at least one air cylinder. Thus, as the diameter of the sheet material being wound around the take-up roll increases, the pneumatic ram of the air cylinder will cause the pneumatic pressure of the air cylinder to correspondingly increase. This increase in pneumatic pressure is sensed by a pneumatic pressure regulator which vents sufficiently to decrease the pneumatic pressure acting on the air cylinder to a predetermined set point pressure. In this manner, the pressure exerted on the sheet material between the positionally fixed press roller and the longitudinally movable take-up roller is maintained substantially constant during production of the nonwoven sheet material.

27 Claims, 11 Drawing Sheets

APPARATUS AND METHOD FOR MAKING MELT-BLOWN NONWOVEN SHEETS

This is a divisional of application Ser. No. 08/725,258, filed Oct. 2, 1996, now U.S. Pat. 5,829,708.

FIELD OF INVENTION

This invention generally relates to the field of melt-blown, nonwoven materials, particular nonwoven sheets. In particularly preferred forms, the present invention is embodied in apparatus and methods whereby melt-blown nonwoven sheet material is made under controlled take-off tensions.

BACKGROUND AND SUMMARY OF THE INVENTION

Apparatus and methods whereby tubular sheets of nonwoven, melt-blown continuous fibers are formed by directing attenuated molten polymer streams toward a rotating collection mandrel are well known in the art as evidenced by U.S. Pat. Nos. 3,905,756 to Bringman, 3,905,734 to Blair, 3,909,174 to Blair et al, 3,933,557 to Pall, 4,021,281 to 4,021,281 to Pall and 4,032,688 to Pall (the entire content of each patent being expressly incorporated hereinto by reference). In general, the apparatus and methods disclosed in the known prior art include a downstream winder assembly which rotates synchronously with the collection mandrel. Thus, the melt-blown fibers are collected on the circumferential surface of the rotating mandrel to form a nonwoven tubular sheet which is withdrawn from the mandrel at a substantially constant rate by the synchronously rotating winding assembly.

During manufacture of nonwoven sheets using a winding assembly which is synchronously rotated with a collection mandrel, it is very important that substantially constant tension be maintained on the sheet as it is being withdrawn from the collection mandrel. Otherwise, variations in sheet tension could result in thickness variations and/or other imperfections in the resulting melt-blown nonwoven sheet product.

Broadly, according to the present invention, substantially constant sheet tension is accomplished by virtue of a continual increase in the longitudinal distance (in relation to the machine direction) between the collection mandrel and the take-up roller. Most preferably, such increased longitudinal distance is achieved according to this invention by mounting the take-up roller for linear movements relative to the collection mandrel to accommodate the increasing diameter of the sheet material being wound convolutely on the take-up roller.

Further tension controls are exercised on the sheet material according to the present invention by means of a pneumatically operated pressure-regulating system. Generally, the pressure-regulating system of the present invention includes at least one rotatable press roller which is longitudinally fixed in position relative to the collection mandrel in contact with the sheet material being wound around the take-up roller. The take-up roller is pneumatically advanced toward the press roller by the pneumatic actuation of at least one air cylinder. Thus, as the diameter of the sheet material being wound around the take-up roller increases, the pneumatic ram of the air cylinder will cause the pneumatic pressure of the air cylinder to correspondingly increase. This increase in pneumatic pressure is sensed by a pneumatic pressure regulator which vents sufficiently to decrease the pneumatic pressure acting on the air cylinder to a predetermined set point pressure. In this manner, therefore, the pressure exerted on the sheet material between the positionally fixed (but rotatable) press roller and the longitudinally movable take-up roller is maintained substantially constant during production of the nonwoven sheet material.

These and other aspects and advantages of the present invention will become more clear after careful consideration is given to the following detailed disclosure of the preferred exemplary embodiments thereof.

BRIEF DESCRIPTION OF THE ACCOMPANYING DRAWINGS

Reference will hereinafter be made to the accompanying drawings wherein like reference numerals throughout the various FIGURES denote like structural elements, and wherein.

DETAILED DESCRIPTION OF THE PREFERRED EXEMPLARY EMBODIMENTS

Accompanying FIGS. 16 depict in various views one particularly preferred embodiment of an apparatus 10 according to this invention for forming sheets of melt-blown nonwoven material. In this regard, the apparatus 10 depicted in FIGS. 1–5 is particularly adapted to continuously forming a tubular sheet TS of such melt-blown nonwoven material which may be collapsed onto itself so as to form an integral two-layer sheet structure or may be cut lengthwise to form one (or more) sheets (as will be explained in greater detail below). Thus, as used herein and in the accompanying claims, the term "sheet" is intended to refer to any relatively broad flat material either in the form of a single layer or in the form of multiple layers (e.g., multiple separate sheet layers superposed on one another or a collapsed tubular structure).

The apparatus 10 is generally comprised of an upstream fiber-collection assembly 12 and a downstream sheet-winding assembly 14. In this regard, the terms "upstream", "downstream" and like terms are used in reference to the machine direction (arrow MD in FIG. 1) of the apparatus 10. Thus, the term "machine direction" is intended to denote the direction of travel (i.e., in the direction parallel to arrow MD) of the tubular sheet TS during production, while the therm "cross-machine direction" is a direction substantially perpendicular to the machine direction (i.e., in the direction substantially perpendicular to arrow MD). Similarly, the terms "longitudinal" is used in relation to a direction parallel to the machine direction (i.e., in the direction parallel to arrow MD), while the term "latitudinal" is used in relation to a direction parallel to the cross-machine direction (i.e., in the direction substantially perpendicular to arrow MD).

Figure 6:
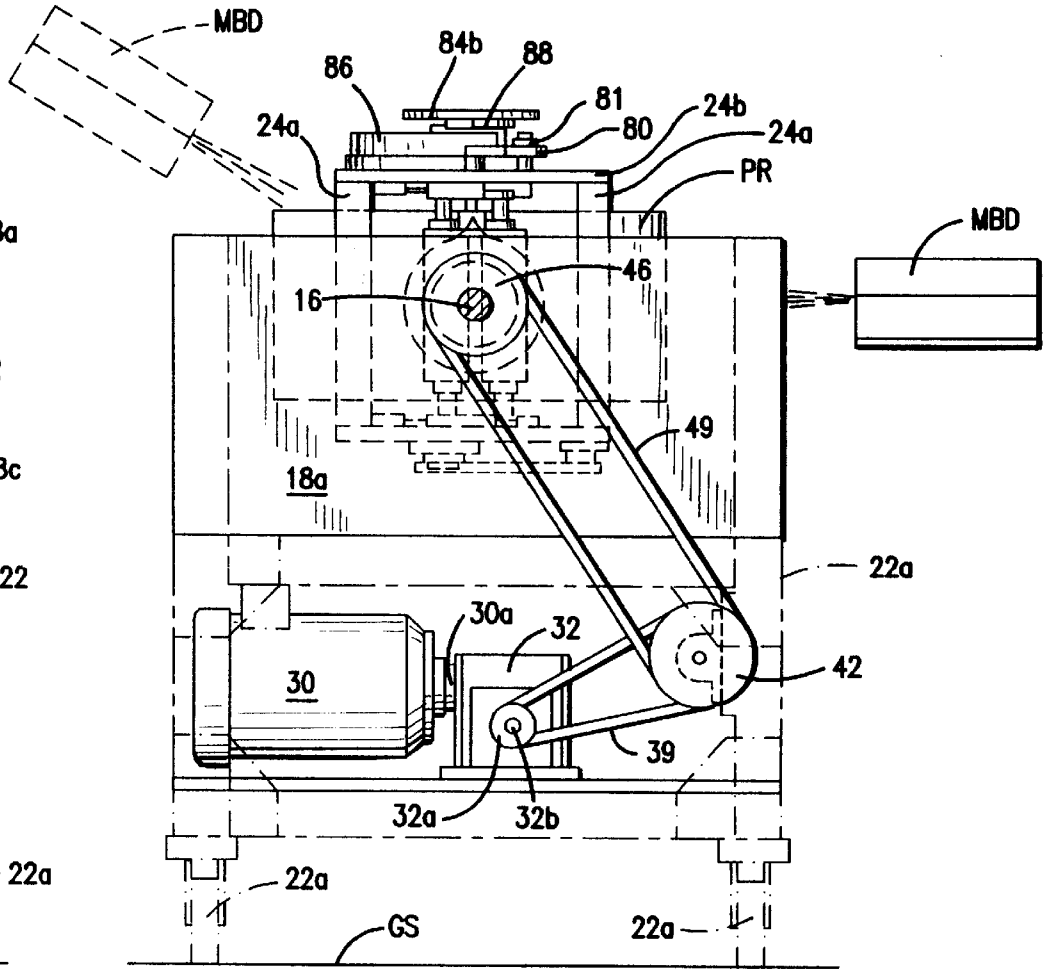
FIG. 6 is a cross-sectional front end elevation view of the apparatus according to this invention as taken along line 6—6 in FIG. 1.
Figure 5:
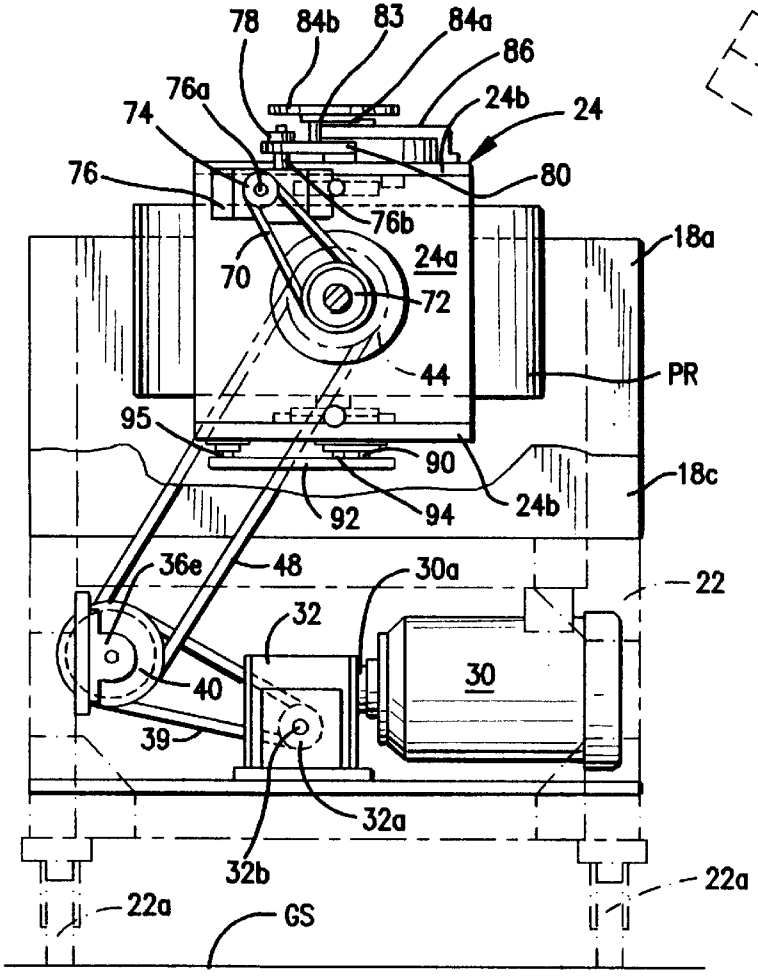
FIG. 5 is a rear end elevation view of the apparatus according to this invention as taken along line 5—5 in FIG. 1.

The fiber-collection assembly 12 includes an elongate fiber collection mandrel 15 which is most preferably slightly tapered in the machine direction. The collection mandrel 15 is positioned so as to receive continuous attenuated streams of melt-blown polymeric material onto its circumferential exterior surface issuing from one (or more) melt-blowing dies MBD (see FIG. 6). As is well known, the continuous streams of melt-blown polymeric material are collected upon the exterior circumferential surface of the rotating mandrel 15 so as to form a melt-blown nonwoven tubular sheet thereon. Multiple melt-blowing dies MBD, if provided, may be oriented and/or operated in accordance with the disclosure of U.S. application Ser. No. 08/433,006 filed on May 2, 1995 (now U.S. Pat. No. 5,591,335) (the entire content of which is expressly incorporated hereinto by reference) so as to form a sheet having at least one layer formed of relatively larger diameter support fibers integrally co-located with relatively smaller diameter fibers.

Figure 1:
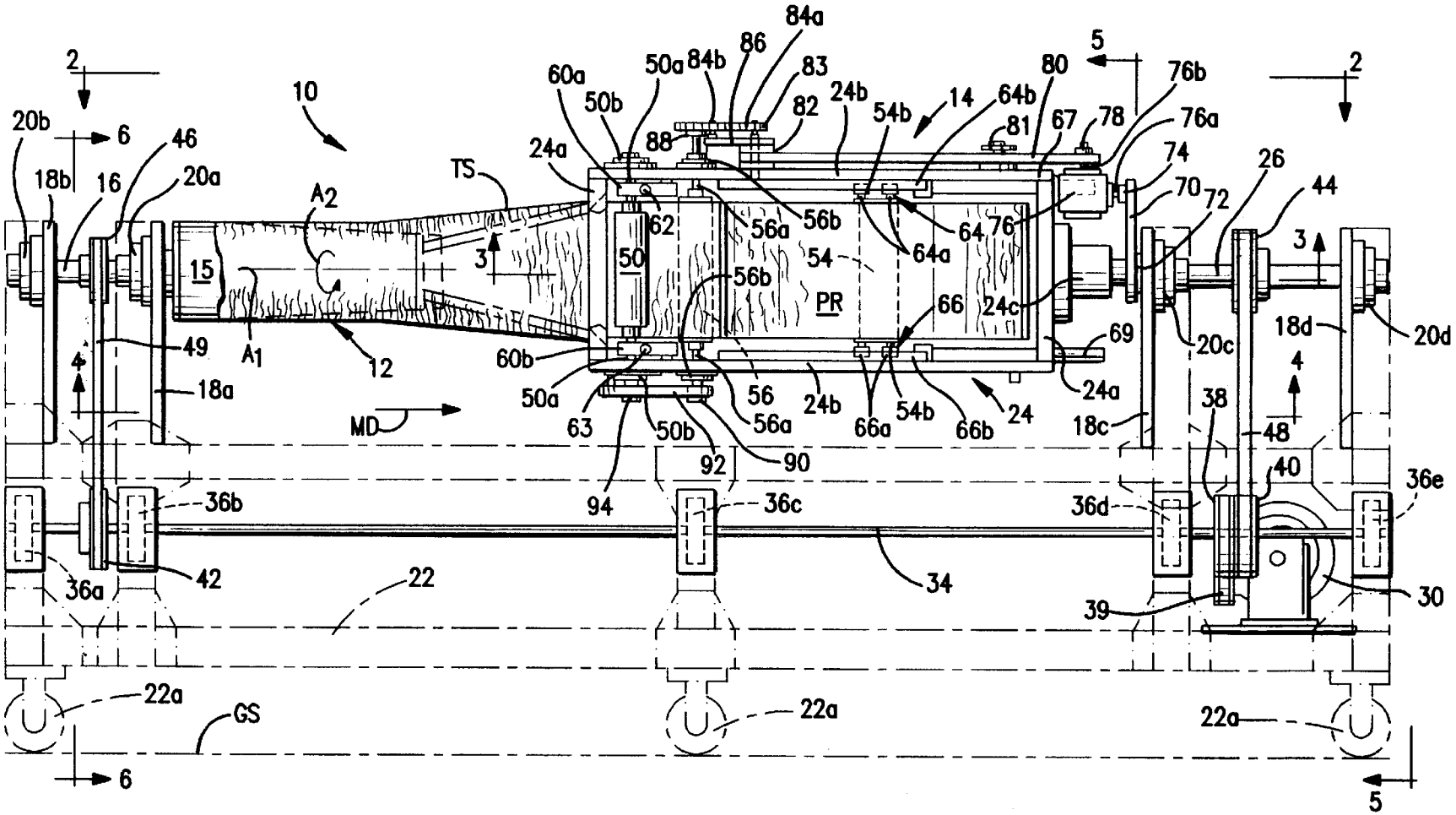
FIG. 1 is a side elevational view of a particularly preferred apparatus according to this invention for forming melt-blown nonwoven sheet material.
Figure 2:
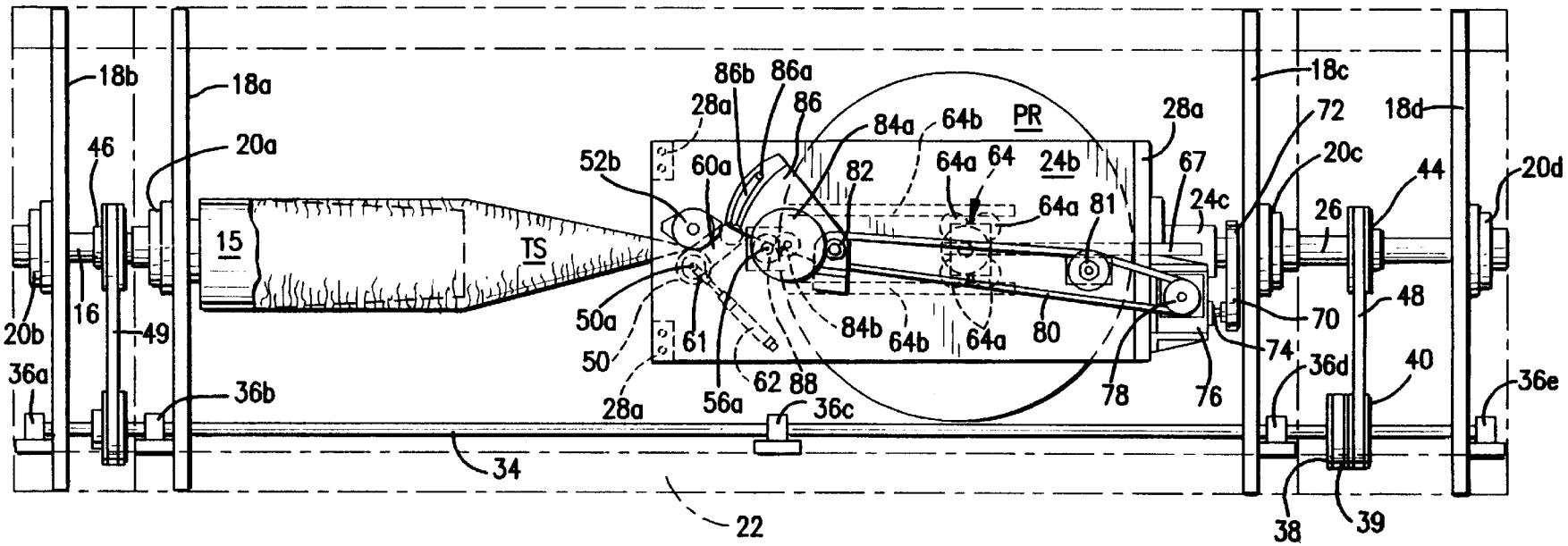
FIG. 2 is a top plan elevational view of the apparatus shown in FIG. 1 as taken along line 2—2 therein.
Figure 3:
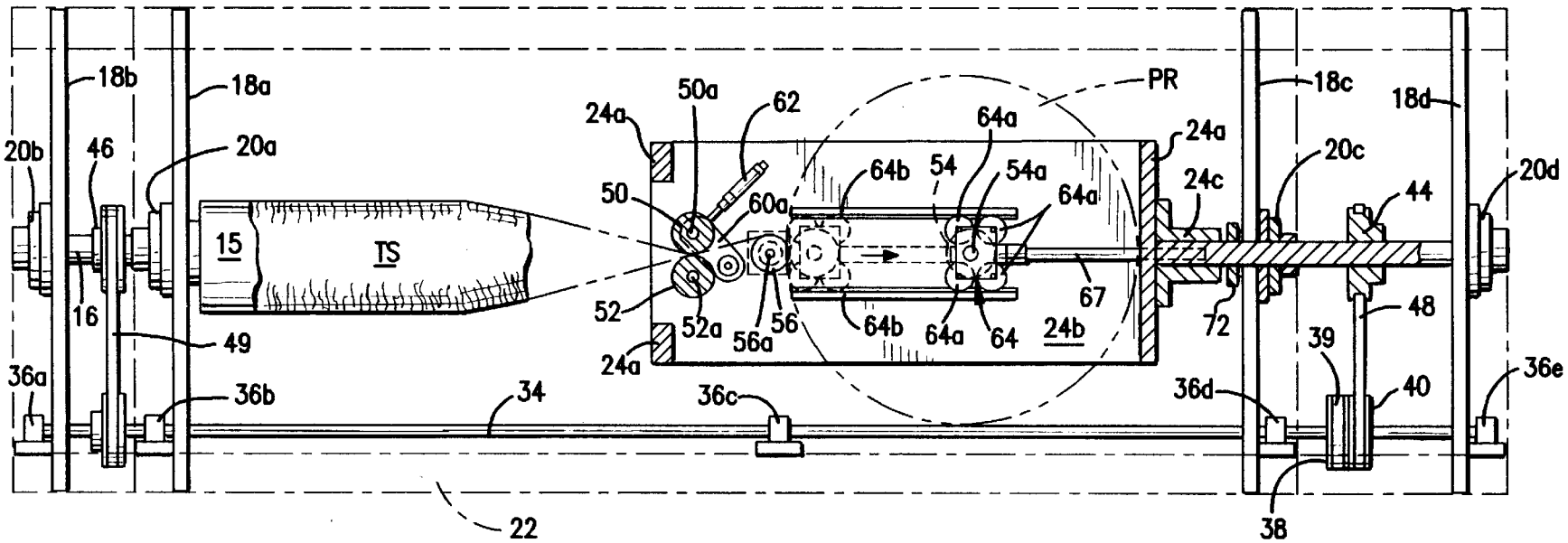
FIG. 3 is partial cross-sectional view of the apparatus according to the present invention as taken along line 3—3 in FIG. 1.

The collection mandrel 15 is connected to a support shaft 16 for rotational movements about the longitudinal machine axis A1 (i.e., is rotated in the direction of arrow A2 in FIG. 1). The shaft 16 is, in turn, connected to upright support plates 18*a,* 18*b* via bearing blocks 20*a,* 20*b,* respectively, so that the collection mandrel 15 is supported in a cantilevered manner forwardly of the plate 18*a*. The upright support plates 18*a,* 18*b* are, in turn a part of the supporting frame 22 (most structural components of which are depicted in chain line in the accompanying drawing FIGURES for clarity of presentation). The supporting frame 22 is most preferably supported by casters 22*a* to allow for rolling movement of the apparatus 10 along the ground surface GS.

The sheet-winding assembly 14 includes a winding frame 24 comprised of opposed, longitudinally separated end frame members 24*a* and an opposed pair of latitudinally separated side frame members 24*b*. The winding frame 24 includes a mounting socket 24*c* which is rigidly connected to shaft 26 coaxially positioned relative to shaft 16 of the fiber-collection assembly 12 along the machine axis A1. The shaft 26 is, in turn, connected to upright support plates 18*c,* 18*d* via bearing blocks 20*c,* 20*d,* respectively, so that the winding frame 24 is supported in a cantilevered manner in advance of the plate 18*c*. The winding frame 24 is thus capable of being rotated in the direction of arrow A2 coaxially with the collection mandrel 15.

The collection mandrel 15 and the winding frame 24 are rotated by means of drive motor 30. More specifically, drive motor 30 has a driven output shaft 30*a* which provides motive input to gear box 32 (see FIGS. 5 and 6). Gear box 32, in turn, is provided with an output drive pulley 32*a* on its output shaft 32*b*. Thus, the motive input provided by the drive motor 30 is translated into rotary movement of the output drive pulley 32*a* via the gear box 32. A common drive shaft 34 is supported by the frame 22 for rotational motion about the shaft's axis by means of bearing blocks 36*a*–36*e*. Thus, as can be seen particularly from FIG. 1, the drive shaft 34 extends substantially the entire longitudinal dimension of apparatus 10 parallel to the machine axis A1 about which the collection mandrel 15 and winding frame 24 rotate.

The drive shaft 34 carries an input drive pulley 38 and a pair of drive take-off pulleys 40, 42. A main drive belt 39 operatively interconnects the input drive pulley 39 to the output drive pulley 32*a* of the gear box 32. The shafts 16, 26, on the other hand, carry input drive pulleys 44, 46 which are operatively interconnected to the take-off pulleys 40, 42, by means of belts 48, 49, respectively. Thus, operation of the drive motor 30 will cause the shaft 34 to rotate at the desired rotational speed (which is determined, for example, by the speed of the motor 30 and/or the gear reduction provided by the gear box 32 and/or the pulleys 32*a,* 38) and direction to cause the collection mandrel 15 and winding frame 24 to rotate in the direction of arrow A2 about the machine axis A1. The pulleys 38–46 are preferably the same diameter and thus exhibit a 1:1 drive ratio. Thus, the rotation of the shaft 34 will translate into speed-synchronized rotational movement of the collection mandrel 15 and the winding frame 24 in the direction of arrow A2.

The winding frame 24 carries a pair of opposed nip rollers 50, 52, a take-up roller 54 and a press roller 56 disposed parallel to one another in the cross-machine direction and mounted to the winding frame 24 for independent rotational movement about their respective roller axles 50*a*–56*a* by means of roller bearings 50*b*–56*b*. The axle 50*a* of roller 50 is connected between a pair of pivotal lever plates 60*a,* 60*b*. In this regard, the opposed ends of axle 50*a* are rotationally carried at the distal ends of the lever plates 60*a,* 60*b* and extend into arcuate slots 61 formed on each of the frame plates 24*b*. The proximal ends of the lever plates 60*a,* 60*b* on the other hand are each connected pivotally to the frame plates 24*b*. Pneumatic actuator cylinders 62, 63 are connected to the lever plates 60*a,* 60*b*. Thus, controlled actuation of the pneumatic cylinders 62, 63 will cause the lever plates 60*a*. 60*b* to pivot about its proximal end which, in turn, causes the nip roller 50 to be moved along an arcuate path towards and away from the other positionally fixed nip roller 52. In such a manner, therefore, the nip rollers 50, 52 may be spread apart to facilitate routing of the tubular sheet material TS during start-up operations.

The take-up roller 54 is mounted for simultaneous rotational movement about its axis and reciprocal longitudinal movements towards and away from the positionally fixed (but rotational) press roller 56. More specifically, the take-up roller 54 is mounted between a pair of latitudinally spaced-apart roller carriage assemblies 64, 66 each of which has opposed pairs of carriage wheels 64*a,* 66*a* mounted for rolling movement between longitudinally parallel carriage tracks 64*b,* 66*b*. Each of the carriage assemblies 64, 66 is connected operatively to a pneumatic actuator cylinder 67, 69 which controls the longitudinal travel of the carriage assemblies 64, 66 (and hence the longitudinal travel of take-up roller 54 carried thereby) towards and away from the press roller 56 (as will be explained in greater detail below with reference to FIG. 7).

The rollers 50–56 are rotated about their respective axles 50*a*–56*a* synchronously with rotation of the winding frame 24 and collection mandrel 15 so as to controllably and continuously withdraw the formed tubular sheet material TS from the mandrel 15 and wind it about the take-up roller 54. More specifically, the rollers 50–56 are rotated at a 1:1 rotation speed ratio by a drive train assembly which receives its rotational input from a toothed timing belt 70. The belt 70 operatively interconnects a stationary sun gear 72 (which is coaxially sleeved over the shaft 26) and a planet gear 74 associated with gear box 76. The gear box 76 is carried by the winding frame 24 in such a manner that the planet gear 74 associated therewith is radially spaced from the sun gear 74. As described previously, rotation of shaft 26 will cause the winding frame 24 (and hence the rollers 50–56 carried thereby) to rotate in the direction of arrow A2. As a result of such rotation, the planet gear 74 will orbit about the stationary sun gear 72 causing the planet gear 74 to rotate. Rotation of the planet gear 72 is input via gear box shaft 76*a* and translated by the gear box 76 into rotation of its output shaft 76*b* thereby rotating the associated roller drive pulley 78.

A primary roller drive belt 80 interconnects the primary drive pulley 78 with the secondary roller drive pulley 82 mounted to one of the frame plates 24*b* of the winding frame 24. A tensioner pulley 83 is provided so as to maintain proper tension on the drive belt 80. The drive pulley 82 carries a pinion gear 83 which is intermeshed with a primary reduction drive gear 84*a* attached to a support flange segment 86. A secondary reduction drive gear 84*b* is coaxially mounted to the reduction drive gear 84*a* and is intermeshed with the roller gear 88 fixed to the roller axle 56*a*. The support flange segment 86 is pivotally movable about the axis of pinion gear 83 and its associated drive pulley 82 to allow the secondary reduction drive gear 84*b* to be brought manually into and out of engagement with the press roller gear 88. Furthermore, the pivotal movement of the support flange segment 86 permits other gearing ratios to be achieved (i.e., by replacement of different diameter gears 84*a*) so as to rotate the rollers 50–56 at rotational speeds that may be desired without adjustment of the rotational speed of the winding frame 24 and collection mandrel 15. Once the gears 84*b*, 88 are engaged, the support flange segment 86 may be positionally fixed, for example by a nut and bolt assembly 86*a* associated with slot 86*b* (see FIG. 2).

Figure 4:
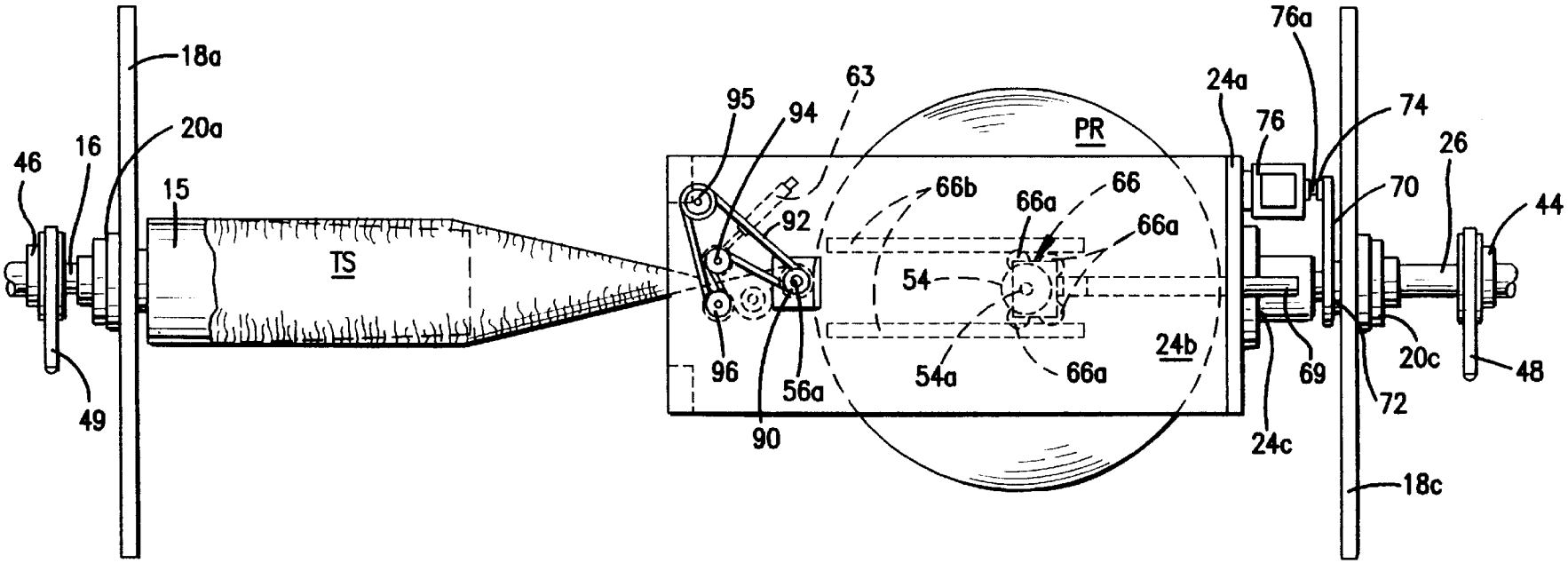
FIG. 4 is a partial view of the apparatus according to this invention as taken along line 4—4 in FIG. 1.

As is perhaps more clearly shown in FIG. 4, the end of axle 56*a* opposite to the press roller gear 88 carries a press roller pulley 90 which is operatively connected via belt 92 to the nip roller pulley 94. The belt 92 is directed around an idler pulley 95 and a tensioner pulley 96, the latter being provided so as to maintain desired tension on the belt 92. As can be appreciated, the driven press roller 56 will responsively drive the take-up roller 54 around its axle since the press roller 56 exerts a pressure against the sheet material wound around the take-up roller 54.

During production, the melt-blowing die(s) MBD will direct molten streams of continuous polymeric fibers toward the collection mandrel 15. The fiber will therefor collect on the surface of the mandrel 15 in the form of a tubular nonwoven mass thereby forming the tubular sheet material TS. The tubular sheet material is continuously taken off the mandrel 15 and collapsed between the nip rollers 50, 52. The collapsed tubular sheet material is then continuously wound around the take-up roller 54 in the manner described previously so as to form a generally cylindrically shaped product roll PR.

It will be appreciated that, during the wind-up operation of the collapsed tubular sheet material TS, the relative diameter of the product roll PR (i.e., the relative diameter of the sheet material wound around the take-up roller 54) increases. In order to maintain substantially constant pressure as between the press roller 56 and the tubular sheet material TS being wound around the take-up roller 54, the latter is controllably and continually moved longitudinally away from the former. As such, the continually increasing relative diameter of the product roll PR is accommodated while, at the same time, substantially constant pressure is applied to the sheet material being wound around the take-up roller 54 by the press roller 56 thereby maintaining substantially constant sheet tension during the wind-up operation.

Figure 7:
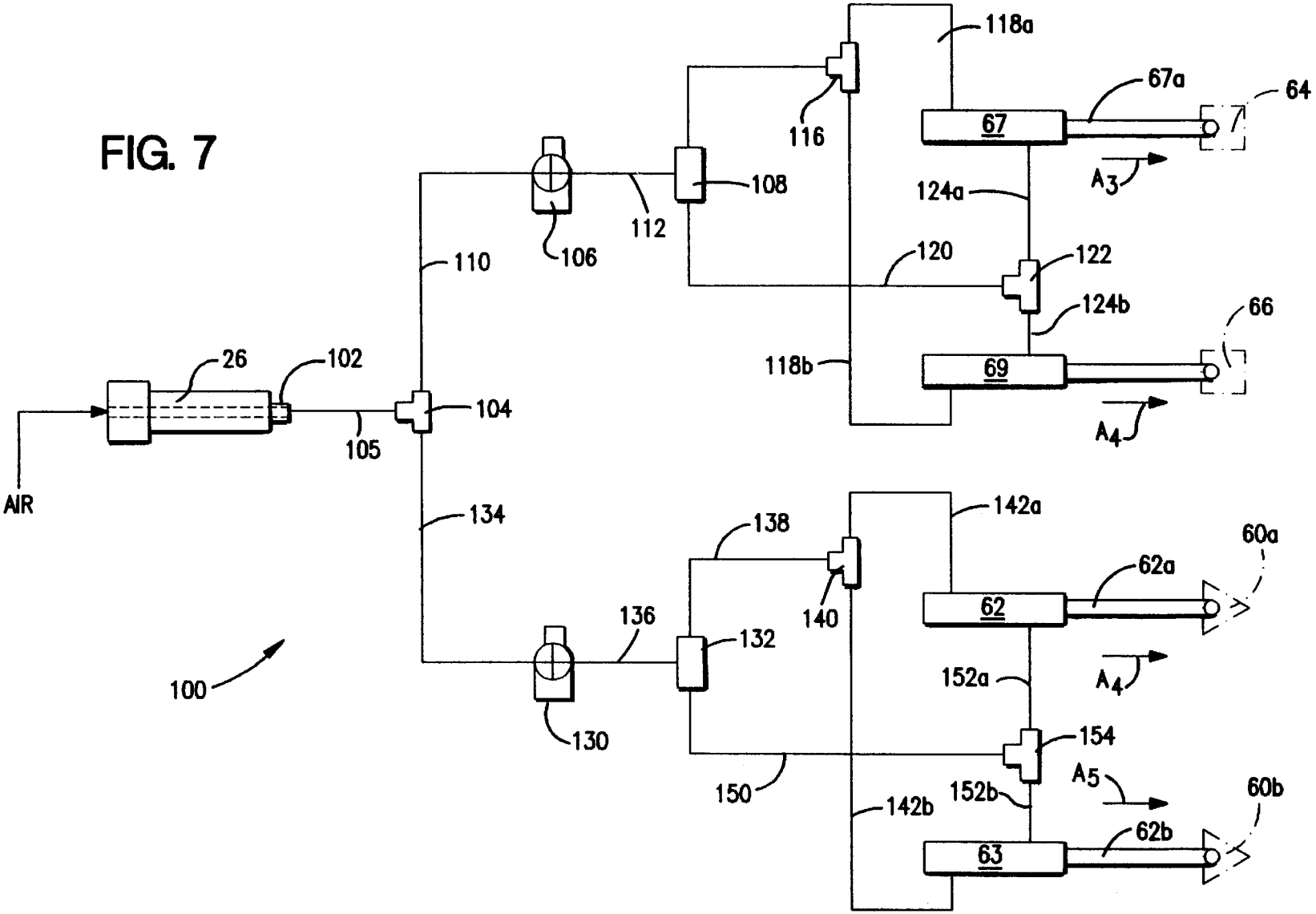
FIG. 7 is a schematic presentation of the pneumatic pressure-regulating system that is preferably employed according to the present invention to control sheet take-up tension.

The pneumatic pressure-regulating assembly 100 which allows the take-up roller 54 to be displaced longitudinally during the wind-up operation and thereby maintain substantially constant pressure between the take-up and press rollers 54, 56, respectively, is shown schematically in accompanying FIG. 7. In this regard, the actuator cylinders 67, 69 are most preferably double acting. As shown, pressurized fluid (e.g., air) is directed coaxially through the shaft 26 by means of a pneumatic slip coupling 102 to a primary pneumatic T-coupling 104 through tubing 105. A portion of the pressurized fluid is thus directed to pressure regulator 106 and then on to a manually actuated pneumatic switch 108 via tubing 110 and 1 12, respectively. During the wind-up operation, the pneumatic switch 108 is set so as to direct the pressurized fluid through conduit 114 to a secondary pneumatic T-coupling 116 which splits the pressurized fluid into branch conduits 118*a*, 118*b*. As shown, the branch conduits 118*a*, 118*b* are respectively fluid-connected to the actuator cylinders 67, 69 in such a manner which tends to extend the actuator arms 67*a*, 69*b* in the directions of arrows A3 and A4, respectively. As a result, the carriage assemblies 64, 66 (noted schematically in FIG. 7 by the chain line rectangular representations thereof) attached to the actuator arms 67*a*, 69*b* carry the take-up roller 54 longitudinally toward the press roller 56.

The pressure regulator 106 is set at a selected set point pressure corresponding to the desired pressure exerted between the take-up roller 54 and press roller 56. As the relative diameter of the product roll PR increases, the take-up roller 54 will be urged responsively to move longitudinally away from the press roller. This longitudinal movement of the take-up roller 54 will thereby cause the actuator arms 67*a*, 69*a* to retract (i.e., be urged in a direction opposite to arrows A3 and A4, respectively). As a result, the pressure within the pneumatic tubing 118*a*, 118*b* will increase and be sensed by the pressure regulator 106 via the fluid-communication provided by pneumatic conduits 112 and 114. In response to the sensed increased pneumatic pressure exceeding the set point pressure, the pressure regulator 106 will vent some of the pressurized fluid to the ambient environment until the set point pressure is reestablished. This pressure regulation process as described above repeats itself continually during the winding operation so as to maintain the pressure between the take-up roller 54 and the press roller 56 substantially constant throughout the entirety of the winding operation.

Upon completion of the winding operation (i.e., at a time when the take-up roller 54 has the maximum desired amount of sheet material TS wound therearound), the switch 116 may be activated so as to direct pressurized fluid into the pneumatic tubing 120. The pressurized fluid in pneumatic tubing 120 is split by the secondary T-coupling 122 and directed to the cylinders 67, 69 via tubing 124*a*, 124*b*. The tubing 124*a*, 124*b* is fluid-connected to the actuator cylinders 67, 69 in such a manner as to cause the actuator arms 67*a*, 69*a* thereof to fully retract (i.e., move in a direction opposite to arrows A3 and A4). The carriage assemblies 64, 66 (and hence the take-up roller 54 carried thereby) will thus be fully retracted relative to the press roller 56 to enable the product roll PR of sheet material TS to be removed along with the take-up roller 54 and replaced with a fresh (empty) take-up roller. Thereafter, the switch 116 may again be actuated to cause the pressurized fluid to flow into the branch tubing 118*a*, 118*b* as described above and thereby advance the arms 67*a*, 69*a* toward the press roller 56 until the desired pressure between the press roller 56 and the fresh take-up roller 54 is again established. At that time, the winding operation may again proceed using the fresh take-up roller 54 to wind-up additional sheet material TS.

The system 100 shown in FIG. 7 is also provided with a pneumatic control branch cause substantially constant pressure to be exerted on the sheet material TS between the nip rollers 50, 52. In this regard, some of the pressurized fluid supplied the T-coupling 104 will be directed through another pressure regulator 130 and on to a manually actuated pneumatic switch 132 via pneumatic tubing 134, 136, respectively. During normal winding operations, the switch 132 will be positioned so that the pressurized fluid is directed through tubing 138 to T-coupling 140 which splits the fluid into the branch conduits 142*a*, 142*b*. Similar to the pneumatic system described previously, each of the pneumatic tubing 142*a*, 142*b* is connected to a respective cylinder 62, 63 so as to extend the actuator arms 62*a*, 63*a* thereof (i.e., in the direction of arrows A5 and A6, respectively). Extension of the actuator arms 62*a*, 63*a* will in turn responsively pivot the lever plates 60*a*, 60*b* (noted schematically in FIG. 7 by the chain line triangular representations thereof) causing the nip roller 50 to be moved towards the other positionally fixed nip roller 52 until the pressure between the nip rollers 50, 52 is at the set point pressure of the regulator 130. Any upset in the nip roller pressure 50, 52 will thus be controlled by the pressure regulator 130 so as to achieve the set point pressure.

The nip roller 50 may be fully moved away from the nip roller 52 by actuation of the switch 132 so as to direct the pressurized fluid into tubing 150 and then on to the cylinders 62. 63 via branch lines 152*a*, 152*b* extending from T-coupling 154. In this regard, the branch lines 152*a*, 152*b* are fluid-connected to the cylinders 62, 63 so that when pressurized the actuator arms 62*a*, 63*a* retract (i.e., in a direction opposite to arrows A5, A6) to cause the lever plates 60*a*. 60*b* to pivot and carry the nip roller 50 away from its opposed nip roller 52.

Figure 8:
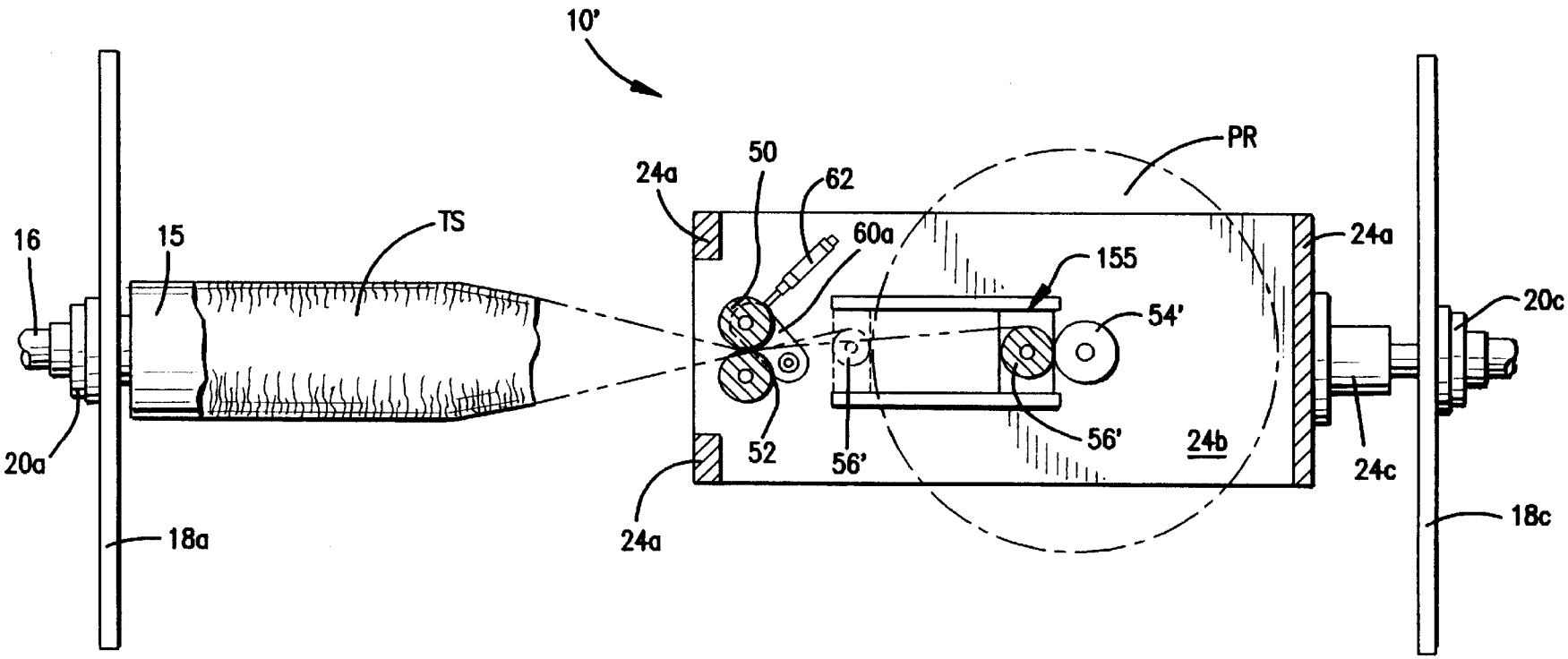
FIG. 8 is a schematic view of an alternative embodiment of the apparatus according to the present invention whereby the press roller is mounted for longitudinal movements relative to a positionally fixed (but rotatable) take-up roller.

The discussion above with respect to apparatus 10 has focussed upon reciprocal longitudinal movements of the take-up roller 54 relative to a positionally fixed (but rotatable) press roller 56. However, such an arrangement represents only a preferred exemplary embodiment of the present invention. Thus, FIG. 8 depicts an embodiment of an apparatus 10' of this invention whereby the rotatable take-up roller 54' is positionally fixed, but the press roller 56' is mounted on suitable carriage assemblies 155 to allow for its longitudinal movements—e.g., in a manner opposite to that described above. In such a situation, therefore, the pneumatic control assembly would be operatively interconnected to the press roller 56 so as to maintain substantially constant pressure between the rollers 54, 56 during the entire winding operation.

Furthermore, the apparatus 10 has been described above in connection with the production and wind-up of a collapsed tubular sheet TS. Accompanying FIGS. 9–12, however, depict alternative embodiments of this invention which are especially useful in separately winding flat, single layer sheets formed by slitting the tubular sheet material TS in advance of take-up. In this regard, accompanying FIGS. 9–12 depict schematically several embodiments of this invention whereby the tubular sheet TS withdrawn from the collection mandrel 15 is diametrically slit along opposed slit lines to form two longitudinal sheet sections SS1, SS2 which are wound up separately o form separate generally cylindrical sheet product rolls PR1 and PR2, respectively.

Figure 9:
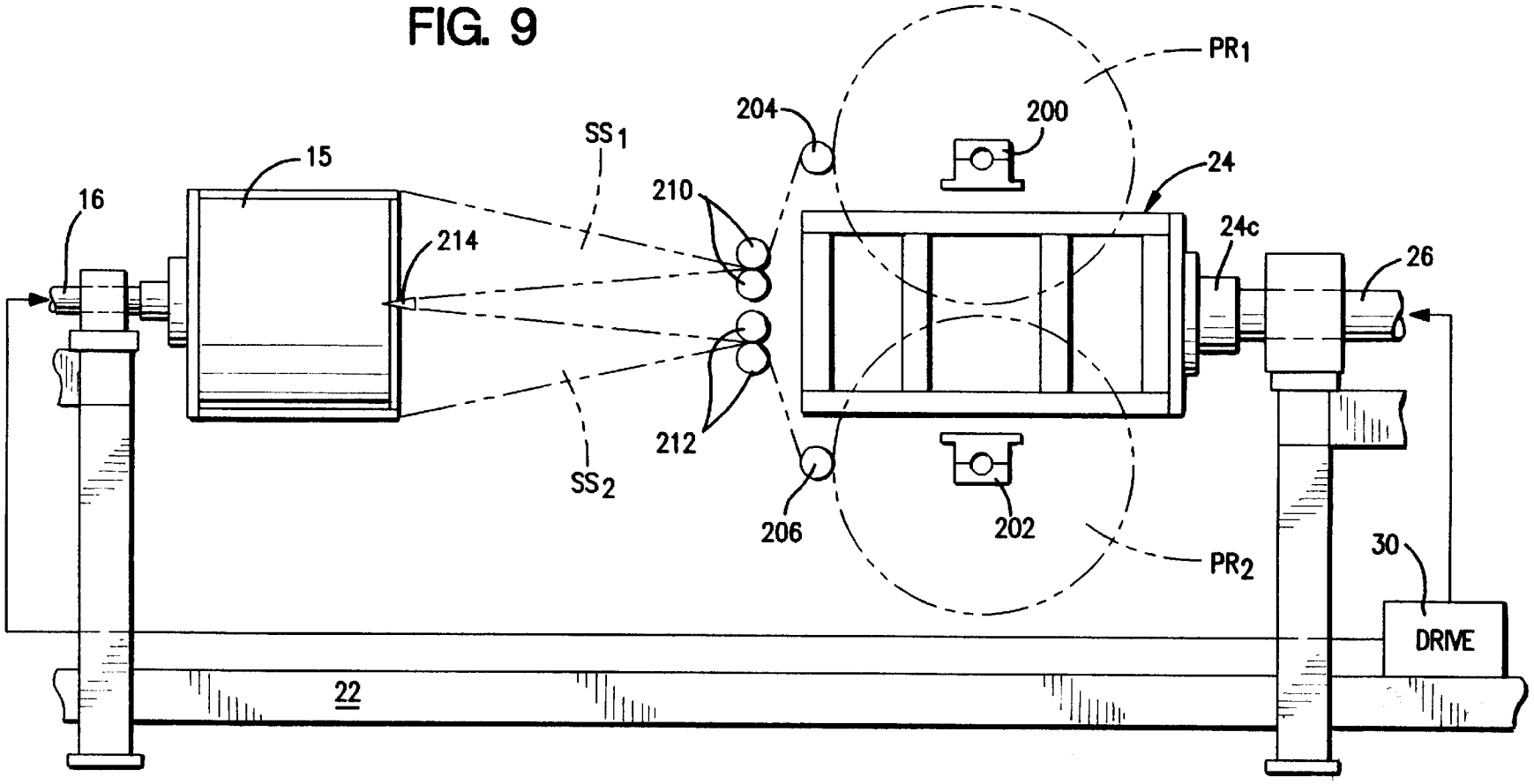
FIG. 9 is a schematic side elevational view of another embodiment of an apparatus according to this invention which employs a tubular sheet slitter and dual take-up rolls.

Accompanying FIG. 9 shows a pair of take-up roller assemblies 200, 202 mounted upon the winding frame 24. The take-up roller assemblies 200, 202 thus rotate as a unit with rotation of the winding frame 24 about the longitudinal machine axis. Although not shown, the take-up roller assemblies 200, 202 are mounted to the winding frame 24 via carriage structures similar to those described above and disposed in guideways on the winding frame so as to allow for reciprocal longitudinal movements of both such take-up roller assemblies 200, 202. A pair of positionally fixed (but rotatable) press rollers 204, 206 are provided so as to press against the sheets SS1, SS2 being wound by roller assemblies 200, 202. Pairs of nip rollers 210, 212 are provided so as to flatten the sheets SS1, SS2, respectively, prior to being directed to the take-up roller assemblies 200, 202.

In order to form the separate sheets SS1, SS2, a diametrically opposed pair of slitters 214 (only one such slitter 214 being visible in FIG. 9) is provided at the downstream end of collection mandrel 15. The slitters 214 thus rotate as a unit with the mandrel 15 to slit the tubular sheet material being withdrawn therefrom along a diametrical parting plane and thereby form the individual sheets SS1, SS2.

Figure 10:
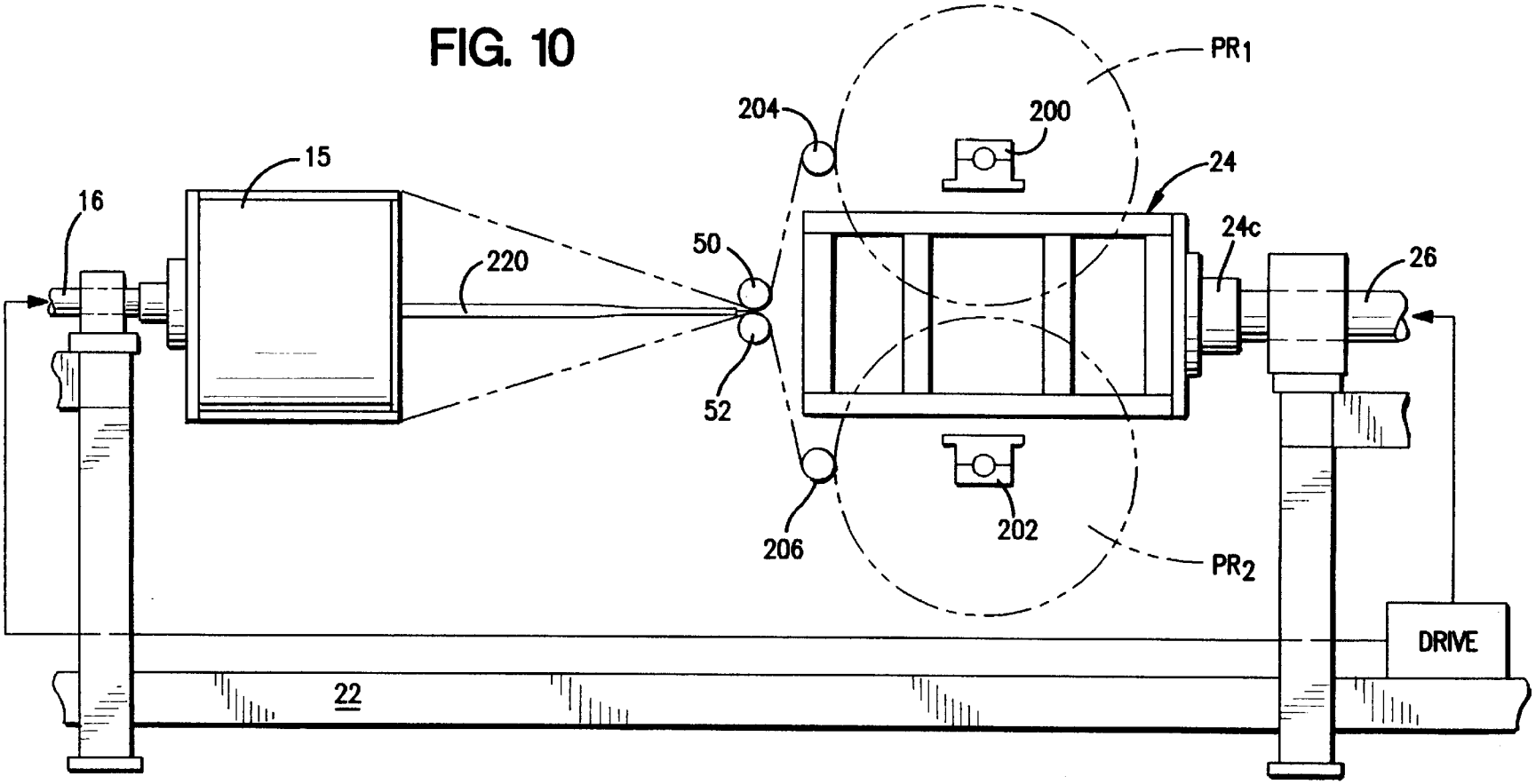
FIG. 10 is a schematic side elevational view of another embodiment of an apparatus according to this invention similar to the apparatus depicted in FIG. 9, but employing a different sheet slitter.

FIG. 10 shows an alternative embodiment of an apparatus according to this invention whereby the slitter is in the form of a pair of longitudinally extending arms 220 (only one such arm being shown) carrying a slitter blade at their respective terminal ends. The slitter arms 220 of FIG. 10 have the advantage of slitting the tubular sheet TS just prior to its being collapsed by the nip rollers 50,52. Thus, a single pair of nip rollers 50,52 can be employed in the embodiment of FIG. 10 to service each of the assemblies 200, 202.

Figure 11:
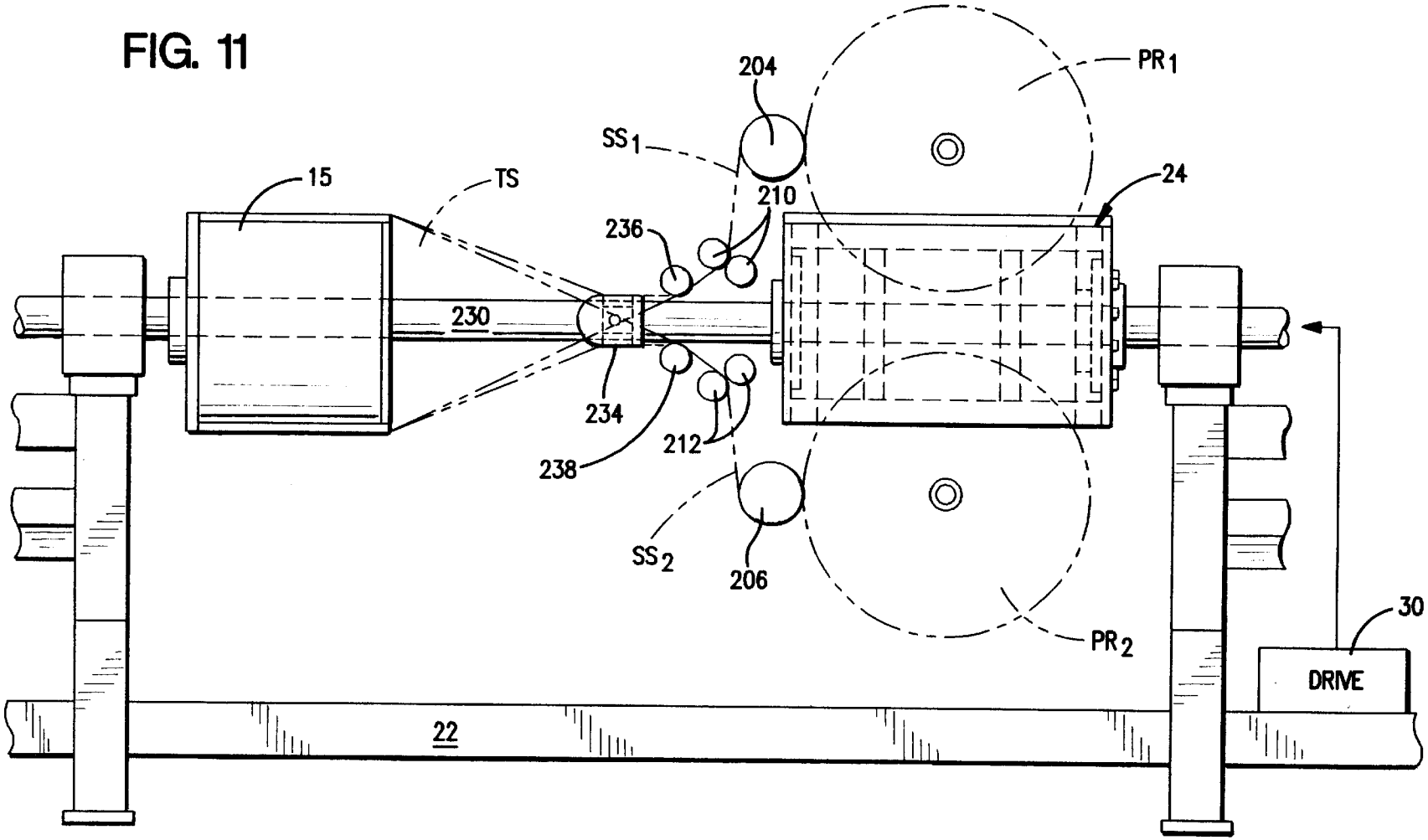
FIG. 11 is a schematic side elevational view of another embodiment of an apparatus according to this invention similar to the apparatus depicted in FIG. 9, but employing a different sheet slitter.
Figure 12:
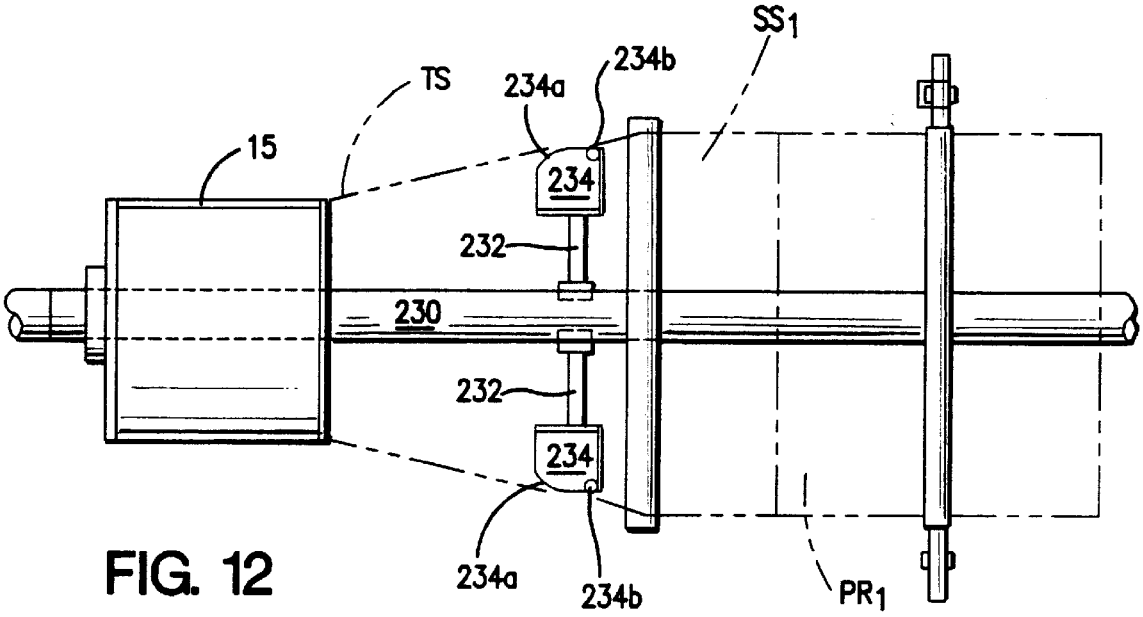
FIG. 12 is a partial schematic top plan view of the apparatus depicted in FIG. 11.

The embodiment of the apparatus of this invention shown in accompanying FIGS. 11 and 12 employs a common rotatable shaft 230 to which the mandrel 15 and the winding frame 24 are attached. As shown, the shaft 230 rigidly carries a pair of radially opposed slitter arms 232 which terminate in slitter heads 234. The slitter heads 234 are preferably formed with a smoothly arcuate upstream surface portion 234*a* which serves to longitudinally guide and latitudinally collapse the tubular sheet material TS being withdrawn from the mandrel 15. Downstream of the surface portion 234*a*, the slitter heads 234 include a slitter blade 234*b*. The tubular sheet material TS is thus slit diametrically to form the separate sheet structures SS1, SS2. An intermediate guide roller 236, 238 may be provided upstream of the nip rollers 210, 212, respectively.

While the embodiments depicted in 9–12 show slitters which serve to slit the tubular sheet material TS along two diametrically opposed slit lines to thereby form two separate sheets SS1, SS2, a slitter could be provided so as to slit the tubular sheet material TS along a single slit line (e.g., similar to the slitter arrangement depicted in the above-cited U.S. Pat. No. 3,905,736), in which case a single layer sheet of melt-blown nonwoven material could be taken up.

Figure 13:
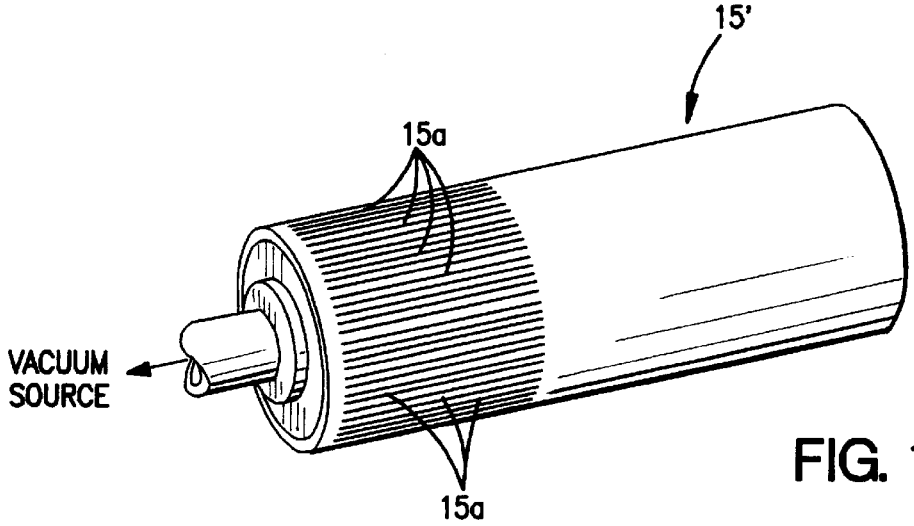
FIG. 13 is perspective view of a modified collection mandrel that may be employed in the apparatus according to the present invention.
Figure 14:
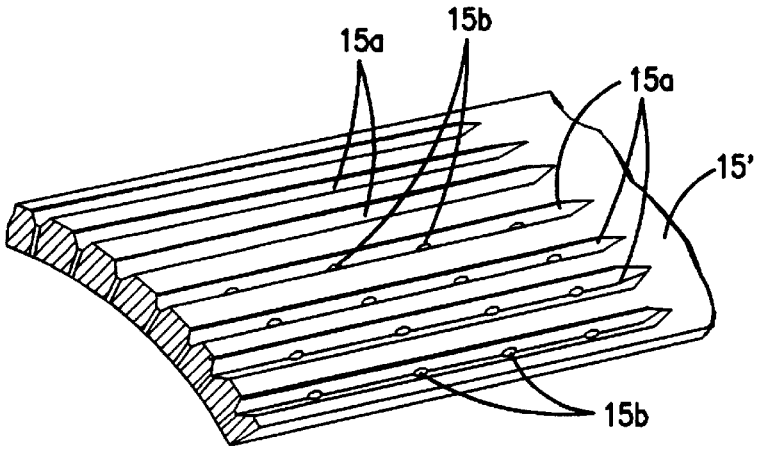
FIG. 14 is an enlarged partial surface detail of the collection mandrel depicted in FIG. 13.

An alternative collection mandrel 15' is shown in accompanying FIGS. 13 and 14. Specifically, the collection mandrel 15' differs principally from the collection mandrel 15 in the presence of radially spaced-apart, longitudinally extending slots (a representative few of which are noted by reference numeral 15*a*) machined in the mandrel's upstream exterior surface region. The collection mandrel 15', like mandrel 15, preferably slightly tapers in a downstream direction so that its downstream diameter is somewhat less as compared to its upstream diameter. The slots 15*a* reduce the surface are of the mandrel 15*a* in contact with the melt-blown fibers being laid down by means of melt-blowing die(s) MBD and thereby serve to decrease frictional resistance in withdrawing the formed tubular sheet TS therefrom.

The slots 15*a* are each most preferably provided with a series of co-located apertures (a representative few of which are identified by reference numeral 15*b*) connected to a source of vacuum through hollow shaft 16. A slight vacuum is drawn through the slots 15*a* which serves to promote positive fiber lay-own onto the surface of the collection mandrel 15'. The magnitude of the vacuum cannot be too great as to disrupt withdrawal of the tubular sheet TS from the mandrel 15', however.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. Apparatus for making a sheet of melt-blown nonwoven fibers comprising:

a melt-blowing die;

a collection mandrel positioned to collect melt-blown fibers from the melt-blowing die and form a sheet of melt-blown nonwoven fibers thereon;

a winding assembly having (i) a winding frame rotatable about said machine axis, (ii) a take-up roller downstream of the collection mandrel to wind the sheet around the take-up roller, and (iii) a carriage assembly, wherein said take-up roller is rotatably mounted to said carriage assembly, and wherein said carriage assembly is mounted to said winding frame for longitudinal movements between first and second longitudinally separated positions;

said collection mandrel and winding assembly being mounted for synchronous concurrent rotation about a common longitudinal machine axis; and said take-up roller being longitudinally moveable along said machine axis between said first and second longitudinally separated positions simultaneously with said concurrent rotation of said collection mandrel and said winding assembly thereabout.

2. Apparatus as in claim 1, further comprising a press roller positioned parallel to said take-up roller.

3. Apparatus as in claim 2, further comprising a pneumatic pressure-regulating system which regulates the pressure exerted on said sheet between said press and take-up rollers.

4. Apparatus as in claim 3, wherein said pneumatic pressure-regulating system is operatively connected to said take-up roller and longitudinally moves said take-up roller in response to sensing a pressure exerted on said sheet between said press and take-up rollers which exceeds a set-point pressure.

5. Apparatus as in claim 1, further comprising a pneumatic system operatively connected to move said take-up roller longitudinally between said first and second positions.

6. Apparatus as in claim 1, further comprising a pair of nip rollers in advance of said take-up roller.

7. Apparatus as in claim 1, wherein said sheet is a tubular sheet and said apparatus includes a slitter which slits the tubular sheet longitudinally.

8. Apparatus as in claim 7, wherein said slitter slits the tubular sheet longitudinally along diametrically opposed slit lines to form at least first and second sheets.

9. Apparatus as in claim 8, wherein said winding assembly includes a pair of said take-up rollers to wind a respective one of said first and second sheets.

10. Apparatus for forming a melt-blown nonwoven fibrous sheet comprising:

a collection mandrel rotatable around a longitudinal machine axis for collecting melt-blown fibers and form thereon a nonwoven sheet; and a winding assembly having a winding frame mounted for rotation about said longitudinal machine axis concurrently with said collection mandrel, said winding assembly including, (i) a take-up roller for winding the sheet therearound;

(ii) a carriage assembly for mounting said take-up roller for simultaneous rotational movement about a winding axis perpendicular to said machine axis and for reciprocal longitudinal movements parallel to said machine axis;

(iii) a rotatable press roller mounted parallel to said take-up roller and positioned to exert pressure on the sheet wound around said take-up roller; and (iv) a pressure-regulating system connected operatively to said carriage assembly for moving said take-up roller longitudinally to maintain said pressure exerted by said press roller substantially constant.

11. Apparatus as in claim 10, wherein said pressure-regulating system is pneumatic.

12. Apparatus as in claim 10, wherein said pressure-regulating system includes a pneumatic cylinder connected operatively to said carriage assembly, and a pneumatic pressure-regulator fluid-connected to said cylinder.

13. Apparatus as in claim 10, further comprising an opposed pair of nip roller mounted to said winding frame in advance of said press and take-up rollers.

14. Apparatus as in claim 13, wherein said pressure regulating system is operatively connected to said nip rollers for maintaining a substantially constant nip pressure therebetween.

15. Apparatus as in claim 14, wherein said pressure-regulating system is operatively connected to one of said nip rollers and spatially adjusts said one nip roller relative to the other nip roller to maintain a substantially constant nip pressure therebetween.

16. Apparatus as in claim 15, wherein said pressure-regulating system includes a pneumatic cylinder operatively connected to said one nip roller, and a pressure-regulator fluid-connected to said one nip roller.

17. Apparatus as in claim 1 or 10, further comprising a drive motor operatively connected to both said mandrel and said winding frame for concurrently synchronously rotating said mandrel and said winding frame in the same direction around said machine axis.

18. Apparatus as in claim 2 or 10, further comprising a roller drive system for rotating said press roller.

19. Apparatus as in claim 18, wherein said roller drive system includes, a stationary sun gear coaxial with said machine axis, a gear box mounted to said winding frame for rotation therewith around said machine axis, said gear box having an input shaft and an output shaft, said input shaft having a planet gear operatively interconnected to said sun gear and orbiting said sun gear upon rotation of said winding frame, said output shaft being operatively interconnected to said press roller, wherein rotation of said winding frame around said machine axis responsively rotates said press roller.

20. A method of making a sheet of melt-blown nonwoven fibers comprising the steps of:

(a) collecting melt-blown fibers on a surface of generally cylindrical collection mandrel while rotating the collection mandrel around a longitudinal machine axis to form a sheet of melt-blown nonwoven fibers thereon;

(b) withdrawing the sheet from the collection mandrel and winding the withdrawn sheet around a take-up roller simultaneously rotating around said machine axis and a winding axis which is perpendicular to the machine axis; and (c) longitudinally moving the take-up roller along said machine axis simultaneously while rotating said take-up roller around both said machine and said winding axes.

21. The method of claim 20, further comprising:

(d) mounting a press roller parallel to the take-up roller so that said press roller exerts a pressure on the sheet wound around the take-up roller;

(e) maintaining said pressure exerted on the sheet by the take-up roller substantially constant.

22. The method of claim 21, wherein step (e) includes sensing the pressure exerted on the sheet by the take-up roller; and in response to a sensed pressure greater than a desired set-point pressure, allowing the take-up roller to move longitudinally until said desired set-point pressure is established.

23. The method of claim 22, wherein said step (c) is practiced using a pneumatic pressure-regulating system.

24. The method of claim 20, wherein the sheet is tubular and wherein the method further comprising slitting the sheet longitudinally.

25. The method of claim 24, wherein said slitting is practiced by slitting said tubular sheet along diametrically opposed slit lines to form separate individual sheets.

26. The method of claim 25, wherein each of said separate individual sheets is wound simultaneously around a respective take-up roller.

27. The method of claim 26, wherein each of said respective take-up roller is longitudinally moved along said machine axis simultaneously while rotating each said respective said take-up roller around both said machine and said winding axes.

* * * * *